US005911284A

United States Patent [19]

von Gynz-Rekowski

[11] Patent Number: 5,911,284

[45] Date of Patent: Jun. 15, 1999

[54] DOWNHOLE MUD MOTOR

[75] Inventor: Gunther von Gynz-Rekowski, Houston, Tex.

[73] Assignee: Pegasus Drilling Technologies L.L.C., Houston, Tex.

[21] Appl. No.: 08/885,377

[22] Filed: Jun. 30, 1997

[51] Int. Cl.[6] ..... E21B 4/02

[52] U.S. Cl. ..... 175/107; 417/903

[58] Field of Search ..... 175/61, 73, 74, 175/101, 107; 415/903; 418/201.1

[56] References Cited

U.S. PATENT DOCUMENTS

| | | | |
|---|---|---|---|
| 2,883,156 | 4/1959 | Davenport | 175/107 X |
| 4,011,917 | 5/1977 | Tiraspolsky et al. | 175/107 |
| 4,314,615 | 2/1982 | Sodder, Jr. et al. | 175/94 |
| 4,397,619 | 8/1983 | Alliquander et al. | 418/48 |
| 4,522,272 | 6/1985 | Beimgraben | 175/107 X |
| 4,711,006 | 12/1987 | Baldenko et al. | 29/888 |
| 4,764,094 | 8/1988 | Baldenko et al. | 418/5 |
| 4,820,135 | 4/1989 | Simmons | 417/391 |

FOREIGN PATENT DOCUMENTS

| | | | |
|---|---|---|---|
| 4113986 | 11/1992 | Germany | 175/107 |

OTHER PUBLICATIONS

Hughes Christensen Drill Bit Catalog Sheet; 12 1/4 GT–1 (1996).

Hughes Christensen Drill Bit Catalog Sheet; 8 1/2 GT–1 (1995).

Hughes Christensen Drill Bit Catalog Sheet; 8–1/2 MX–1 (1998).

Allweiler Drill Bit Catalog Sheet; Screw Pumps Series USN (date unknown).

Houttuin Pompen B.V. Catalog Sheet; Double entry two screw pumps, Series 236.00/4 (date unknown).

Leistritz Drill Bit Catalog Sheet; L2 Series (date unknown).

Wenzel Downhole Motors Optimize Your Drilling Efficiency (date unknown).

"What's Happening in Drilling," World Oil (Nov. 1995).

*Primary Examiner*—David J. Bagnell
*Attorney, Agent, or Firm*—Rosenblatt & Redano P.C.

[57] ABSTRACT

A downhole motor operated by circulating mud fluid in the wellbore is revealed. The motor has nested rotors and is geared to a bit drive. The motor is a dual-rotor pump that is operated as a motor with mud flow through the rotor housing on end connections. The structures of the rotor housing and the rotors can be made of the same material. An angular offset can be incorporated between the centerline of the output of the motor and the bit drive. In the preferred embodiment, the motor output is through a gear located within a bigger gear connected to the bit so as to provide a speed reducer. The drive between the rotors and the bit can accommodate angular offsets of a predetermined amount for directional drilling. The design is compact and can be used to drill wellbores as small as about 21/2" in diameter, or even smaller.

18 Claims, 4 Drawing Sheets

DOWNHOLE MUD MOTOR

FIELD OF THE INVENTION

The field of this invention relates to drilling with downhole motors, and more particularly to directional drilling with a downhole motor of a particular dual-rotor design.

BACKGROUND OF THE INVENTION

Fluid-powered motors have been in use in drilling assemblies in the past. These designs are primarily a fixed stator rotating rotor, which are powered by fluid flow based on the original principles developed by Moineau. Typical of such single-rotor, progressive cavity downhole motor designs used in drilling are U.S. Pat. Nos. 4,711,006 and 4,397,619. The stator in Moineau motors is built out of elastic material like rubber. Other designs have put single-rotor downhole power sections in several components in series, with each stage using a rotor connected to the rotor of the next stage. Typical of these designs are U.S. Pat. Nos. 4,011,917 and 4,764,094.

Dual-rotor devices have been used as pumps. U.S. Pat. No. 4,820,135 uses a twin-rotor device which is fluid-operated which has output shafts connected to a downhole pump, which is also of the twin-rotor type, for use in producing low-pressure formations and especially if pumping three-phase media (gas-oil-sand). In essence, the twin-rotor design provides the mechanical energy to rotate another twin-rotor downhole pump to pump formation fluids and gases to the surface. U.S. Pat. No. 4,314,615 illustrates a self-propelled drilling head used in large-bore applications where hydraulic fluid is provided to drive twin-rotor motors through supply and return lines. The motors, through a complex planetary gear system, are connected to a bit. The technology and tools shown in U.S. Pat. No. 4,314,615 are used to drill mining shafts and tunnels.

Despite all these prior developments, what has been lacking is a compact design suitable in drilling a typical wellbore which has the desirable features of providing sufficient torque and power to the bit to accomplish the drilling in an expeditious manner. The disadvantages of the single-rotor designs is that they required complex controls to avoid damage if the bit became stuck or if the bit was suddenly picked up while fluid was circulating and the load on the bit relieved. Impurities in the mud were also a problem for the rubber of the stator in this design. Entrained solids and gas were particularly an issue in the reliable operation of the single-rotor, Moineau-type mud motors. Temperature limitations of the Moineau-type mud motor cause unreliable operation, especially for geothermal drilling applications. The control requirements, as well as the output limitations of the single-rotor designs, have been overcome by the present invention, which provides a compact design using a downhole motor having a twin-rotor design which is geared to the bit.

In directional drilling in the past, universal joints have been used, as indicated in some of the above-mentioned patents, to connect the output of the single-rotor power section to the drillbit. Universal joints have also been used to accommodate an offset in the motor housing or drillstring to permit directional drilling. One of the advantageous features of the design of the present invention is to provide, in a compact bottomhole assembly, an angular bend which is accomplished through the gearing of the output of the twin rotors to the drive for the bit. Accordingly, complex structures that use universal joints are eliminated in the present design which can optionally provide for a bend angle as required and accomplish the connection between the bit drive and the rotating rotor through a gear system involving the requisite angular offset. By adaptation of a twin-rotor design used primarily in pumping applications, a compact downhole motor has been developed which can run on the circulating mud, with fewer controls, and can be constructed to accommodate directional drilling. Additionally, vibration is eliminated, which is common in Moineau motors due to orbital movements. Therefore, measurement while drilling procedures can be achieved much more accurately and economically with the present invention. Those and other beneficial features of the present invention will become apparent to those of ordinary skill in the art by a review of the specification and the drawings.

SUMMARY OF THE INVENTION

A downhole motor operated by circulating mud fluid in the wellbore is revealed. The motor has nested rotors and is geared to a bit drive. The motor is a dual-rotor pump that is operated as a motor with mud flow through the rotor housing on end connections. The structures of the rotor housing and the rotors can be made of the same material. An angular offset can be incorporated between the centerline of the output of the motor and the bit drive. In the preferred embodiment, the motor output is through a gear located within a bigger gear connected to the bit so as to provide a speed reducer. The drive between the rotors and the bit can accommodate angular offsets of a predetermined amount for directional drilling. The design is compact and can be used to drill wellbores as small as about 2½" in diameter, or even smaller.

BRIEF DESCRIPTION OF THE DRAWINGS

FIG. 2 is a continuation of the section view of FIG. 1, showing the bit drive and the bottom end of the rotor, as well as the drive in between.

DETAILED DESCRIPTION OF THE PREFERRED EMBODIMENT

Figure 1:
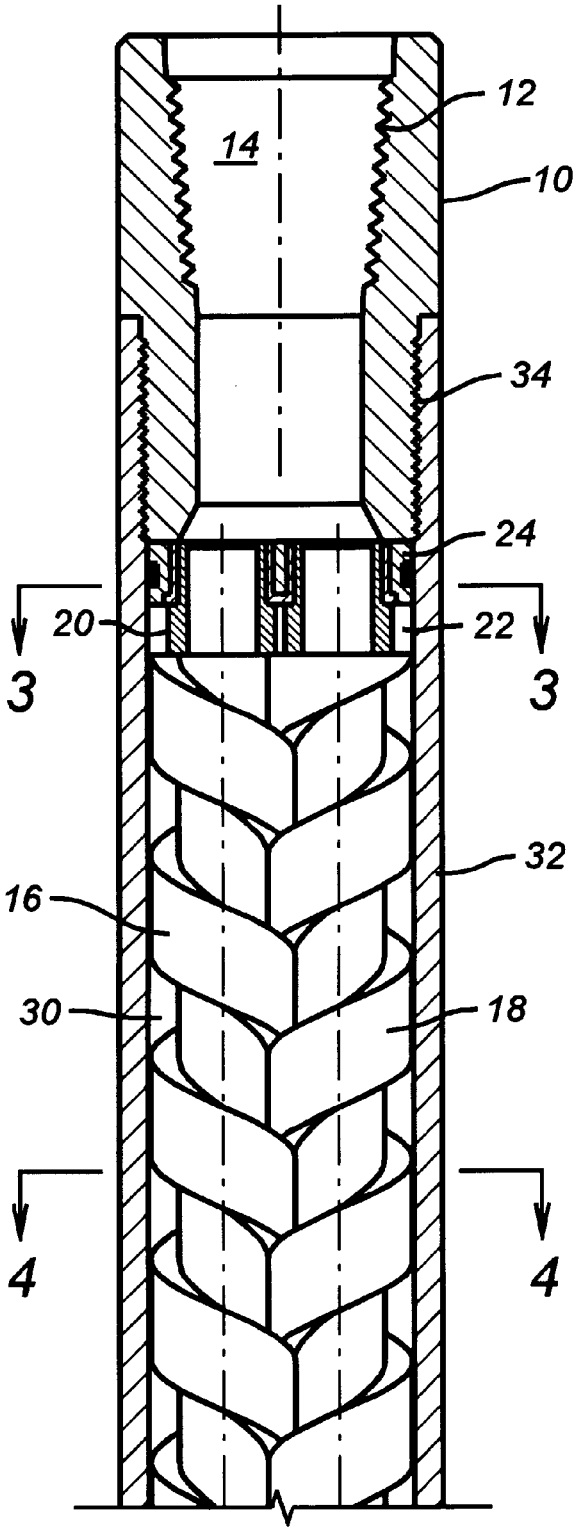
FIG. 1 is the sectional elevational view of the twin rotors component of the downhole assembly.
Figure 2:
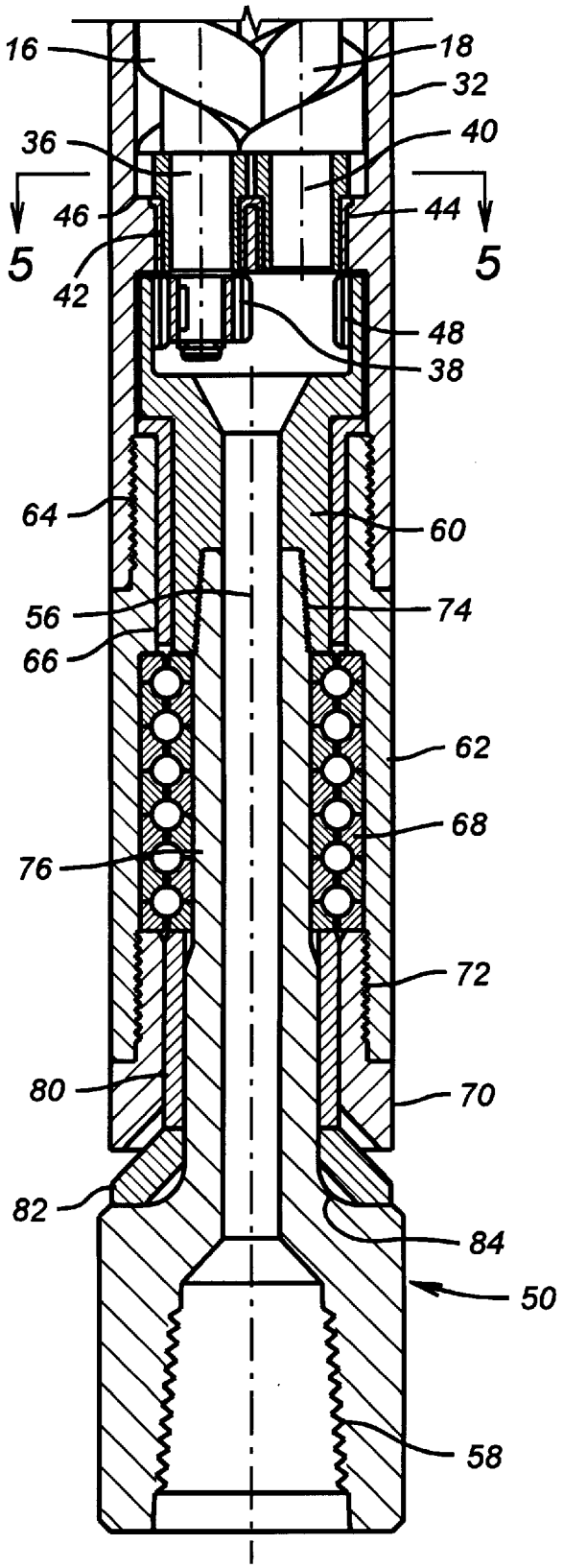
Figure 3:
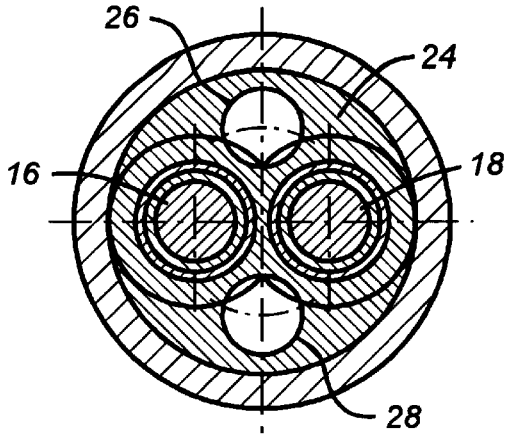
FIG. 3 is a section along lines 3—3 of FIG. 1.
Figure 4:
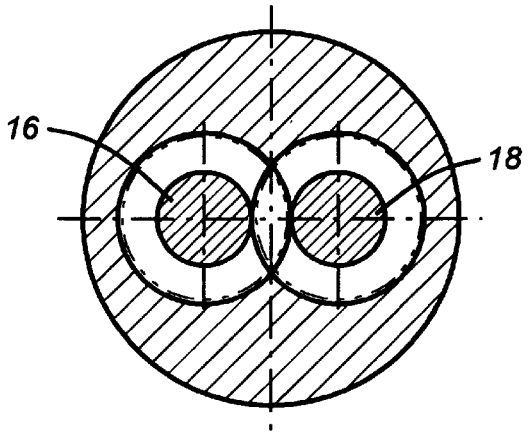
FIG. 4 is a section along 4—4 of FIG. 1.

The present invention is illustrated in FIGS. 1 and 2. A top sub 10 is connected to the drilling string (not shown) at thread 12. Top sub 10 has an inlet path 14 which is in fluid communication with metallic twin rotors 16 and 18. Metallic rotors can be precision machined and are more durable than Moineau pumps which are more difficult to manufacture and have one non-metallic component that can be subject to excessive wear. The rotors 16 and 18, although preferably metallic, can be made of other materials which have similar mechanical properties. Rotors 16 and 18 are supported in bushings 20 and 22, and the bushings 20 and 22 are in turn held in position by an upper bushing plate 24. Rotors 16 and 18 can be axially supported off of shoulder 46 without radial bearing such as bushings 42 and 44, 20 and 22. In this case, the body 32 provides radial support. As shown in FIG. 3, which is section 3—3 of FIG. 1, the bushing plate 24 has openings 26 and 28 which provide fluid communication from inlet 14 into cavity 30 formed by body 32, which is connected to top sub 10 at thread 34. The rotors 16 and 18 are disposed in cavity 30 and are in nested arrangement, as shown in FIG. 1. Accordingly, the inlets 26 and 28 are axial so as to reduce the overall profile of the assembly for drilling of smaller wellbores. Looking further down at the top of FIG. 2, the rotor 16 has an output shaft 36. Shaft 40 is the extension of rotor 18. Both shafts 36 and 40 extend, respectively, through bushings 42 and 44, which are supported by a shoulder 46 on body 32.

Figure 5:
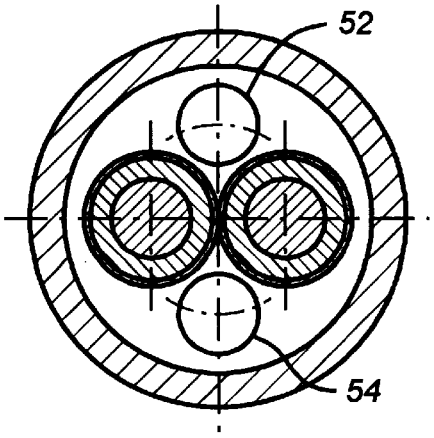
FIG. 5 is a section along 5—5 of FIG. 2.

Gear 38 is meshed to gear 48 mounted to the drive shaft assembly 50. Referring to FIG. 5, cavity 30 has end exit ports 52 and 54 which allow the mud pumped from the surface through inlet 14 and openings 26 and 28 to pass through the chamber 30, which in turn causes rotation of rotors 16 and 18, and ultimately the fluid exits openings 52 and 54 into passage 56 of the drive shaft assembly 50. A bit (not shown) is connected at thread 58. The drive shaft assembly 50 comprises gear sub 60 which, as previously described, has gear 48 mounted internally. A body 62 engages to body 32 at thread 64. A bushing 66 is inserted into the top end of the body 62 before it is made up at thread 64. Bushing 66 is a radial bearing which facilitates the rotation of the drive shaft assembly 50. Thrust transmitted to the drive shaft assembly 50 is taken up in thrust bearing assembly 68. Thrust bearing assembly 68 is supported in part by bottom sub 70 connected to body 62 at thread 72.

Attached to gear sub 60 at threat 74 is output shaft 76. In essence, the bottom sub 70 holds the thrust bearing assembly 68 in position and under compression while the assembled drive shaft assembly 50 is supported from body 32 at thread 64. A lower bushing 80 acts as a radial bearing and is retained between the beveled washer 82, which is in turn supported off of shoulder 84 on output shaft 76 and the inner race of the thrust bearing 68.

As previously stated, flow through the rotor section past rotors 16 and 18 ultimately enters passage 56 where it ultimately goes into the bit (not shown) and into the wellbore to assist in the removal of cuttings during the drilling operation.

Figure 6:
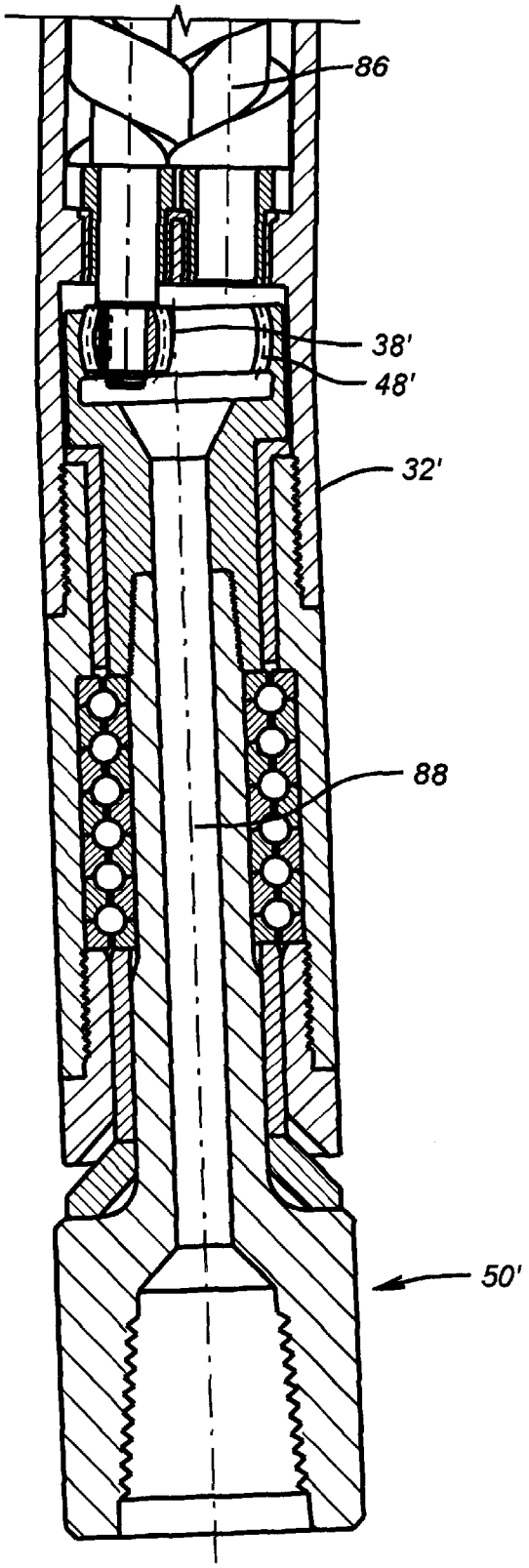
FIG. 6 is an alternative embodiment to FIG. 2, showing an angular displacement in the drive between the motor and the bit.

FIG. 6 is an alternative embodiment to the lower end design shown in FIG. 2. The components are essentially the same, except that the body 32' now has an offset angle between the longitudinal axis of the rotors 16 or 18 shown schematically as 86 and the longitudinal axis of the drive shaft assembly 50' which is shown schematically as 88. To compensate for the offset angle formed between the longitudinal axes 86 and 88, the gear 38' meshes with the gear 48' at the desired angle offset between longitudinal axes 86 and 88. Gears 38' and 48' are preferably of the internal crossed-axis helical gear type which permit such offset angles. In the preferred embodiment, the offset angle for directional drilling is between less than 1° to 10°. However, greater or smaller angles of offset can be designed without departing from the spirit of the invention. In this design, the angular offset is predetermined when the assembly is constructed so that it can be put together in the manner illustrated in FIG. 6 with a predetermined angle built into housing 32'. Those skilled in the art will appreciate that a reconfiguration of the gears 38' and 48' can allow different angles of deviation to be used between longitudinal axes 86 and 88. Accordingly, the assembly could potentially be constructed with a mechanism in the body 32' to allow a reconfiguration of the entire assembly for a deviation angle which could be functional with a gear set 32' and 48'. Thus, there exists a potential for variability in the offset angle between axes 86 and 88 by providing a joint in the body 32' which can assume different angles and a gear set compatible with the angle selected.

One of the advantages of the system of the present invention is that the circulating mud with any entrained solids or trapped gases can be used as the driving force for rotating the bit with the drive shaft assembly 50. The connections within the body 32 to the rotors 16 and 18 are in axial alignment with the remainder of the assembly to give it a low profile. The nesting of gears 38 and 48 allows for a speed reduction which is determined by the needs of the particular installation. However, the nesting arrangement further reduces the profile of the entire assembly to facilitate drilling small wellbores. As opposed to some of the previous designs described above, the present invention does not require a clean circulating system of hydraulic fluid delivered by inlet and outlet lines to a hydraulic motor. Instead, a dual-rotor pump has been adapted as a motor and provided with end connections so that circulating fluid rotates the twin rotors 16 and 18 and power take-off is directly from one of those rotors to the drive shaft assembly 50. A speed reduction is possible, as is a change in the angle of the drive shaft assembly 50 as compared to the upper section housing the rotors 16 and 18. This facilitates directional drilling with the apparatus. As contrasted to prior installations involving a single-rotor progressive-cavity-type, Moineau fluid-powered motor, the complex controls of such prior designs are not necessary in this design. Vibrations are eliminated which are common in Moineau motors due to orbital movements. Fortunately, the body 32 and the rotors 16 and 18 can be manufactured from the same material which will allow a self adjustment of thermal expansion or contraction of these parts downhole. The drive shaft assembly 50 is adequately supported and permitted to easily rotate with respect to body 32. Thrust loads are absorbed back through body 32 through thrust bearing assembly 68. Universal joint drives are eliminated in favor of a direct drive, taking power output from, for example, rotor 16 into gear 38 which, through a speed reduction nesting arrangement, engages gear 48 of the drive shaft assembly 50.

The foregoing disclosure and description of the invention are illustrative and explanatory thereof, and various changes in the size, shape and materials, as well as in the details of the illustrated construction, may be made without departing from the spirit of the invention.

I claim:

1. A well-drilling assembly using a bit shaft driven by a downhole motor, comprising:

an elongated housing;

at least two engaged rotors rotatably mounted in said housing;

at least one of said rotors being operably connected to a bit shaft through a transmission supported in said housing which reduces the bit shaft speed with respect to the rotor speed;

said support for said transmission in said housing insulates said transmission from loads from said housing as torque is transferred therethrough to said bit shaft; and said housing in fluid communication with said bit shaft through said transmission so that a motive medium passing through said housing causes said rotors to turn said transmission and bit shaft as the motive medium passes through said housing and moves through said transmission to said bit shaft.

2. The assembly of claim 1, wherein:

said housing has an upper and lower end and a longitudinal axis; and said housing has an inlet adjacent its upper end and an outlet adjacent its lower end where said inlet and outlet are in substantial alignment with said longitudinal axis of said housing.

3. The assembly of claim 1, wherein:

at least one of said rotors comprises at least a first gear operably connected to at least a second gear on said bit shaft.

4. The assembly of claim 3, wherein:

said bit shaft has a longitudinal axis;

said housing has a longitudinal axis; and said longitudinal axes are in substantial alignment.

5. The assembly of claim 3, wherein:

said bit shaft has a longitudinal axis;

said housing has a longitudinal axis; and said longitudinal axes are misaligned.

6. The assembly of claim 5, wherein:

said housing comprises a joint that allows preselection of the degree of misalignment between said axes;

said gear on said rotor is selected to mesh with a gear on said bit shaft at the selected degree of misalignment of said housings.

7. The assembly of claim 3, wherein:

said bit shaft has an internal gear;

said gear on said rotor is disposed within said gear on said bit shaft so that the rotor speed is greater than said bit shaft's speed.

8. The assembly of claim 7, wherein:

said gears on said bit shaft and said rotor accommodate a predetermined angular misalignment between said rotor and said bit shaft so as to facilitate directional drilling.

9. The assembly of claim 8, wherein:

said misalignment is in the range of up to about 10°.

10. The assembly of claim 9, wherein:

said bit shaft has a longitudinal axis;

said housing has a longitudinal axis; and said longitudinal axes are misaligned.

11. The assembly of claim 9, wherein:

said housing has an upper and lower end and a longitudinal axis;

said rotors are made of a metallic material; and said housing has an inlet adjacent its upper end and an outlet adjacent its lower end where said inlet and outlet are in substantial alignment with said longitudinal axis of said housing.

12. The assembly of claim 11, wherein:

said bit shaft has a flowpath therethrough to allow motive fluid that has passed through said housing and said transmission to pass through the length of said bit shaft to reach the bit.

13. The assembly of claim 12, wherein:

said housing comprises a joint that allows preselection of the degree of misalignment between said axes;

said gear on said rotor is selected to mesh with a gear on said bit shaft at the selected degree of misalignment of said housings.

14. The assembly of claim 7, wherein:

said bit shaft has a longitudinal axis;

said housing has a longitudinal axis; and said longitudinal axes are in substantial alignment.

15. The assembly of claim 7, wherein:

motive medium flows through said internal gear in said bit shaft.

16. The assembly of claim 1, wherein:

said bit shaft has a flowpath therethrough to allow motive medium that has passed through said housing and said transmission to pass through the length of said bit shaft to reach the bit.

17. The assembly of claim 1, wherein:

said housing provides radial and longitudinal support for at least one of said rotors.

18. The assembly of claim 1, further comprising:

bushings mounted in said housing to support at least one said rotor radially and longitudinally.

* * * * *